US010247052B2

(12) United States Patent
Hittle et al.

(10) Patent No.: US 10,247,052 B2
(45) Date of Patent: Apr. 2, 2019

(54) GUIDE ASSEMBLY FOR VALVE LIFTERS OF ENGINES

(71) Applicant: Caterpillar Inc., Peoria, IL (US)

(72) Inventors: Craig P. Hittle, Dunlap, IL (US); Eric L. Schroeder, Germantown Hills, IL (US)

(73) Assignee: Caterpillar Inc., Deerfield, IL (US)

( * ) Notice: Subject to any disclaimer, the term of this patent is extended or adjusted under 35 U.S.C. 154(b) by 72 days.

(21) Appl. No.: 15/663,870

(22) Filed: Jul. 31, 2017

(65) Prior Publication Data

US 2019/0032520 A1 Jan. 31, 2019

(51) Int. Cl.

| | |
|---|---|
| ***F01L 1/14*** | (2006.01) |
| ***F02F 7/00*** | (2006.01) |
| *F01L 1/46* | (2006.01) |

(52) U.S. Cl.

CPC ..... *F01L 1/14* (2013.01); *F02F 7/006* (2013.01); *F01L 1/146* (2013.01); *F01L 1/46* (2013.01); *F01L 2107/00* (2013.01)

(58) Field of Classification Search

CPC ..... F01L 1/14; F01L 1/46; F01L 2107/00
USPC ..... 123/90.5
See application file for complete search history.

(56) References Cited

U.S. PATENT DOCUMENTS

| | | | | |
|---|---|---|---|---|
| 3,668,945 | A | 6/1972 | Hofmann | |
| 6,357,407 | B2 | 3/2002 | Brothers | |
| 7,409,940 | B2 | 8/2008 | Riley | |
| 8,813,706 | B2 | 8/2014 | Remala et al. | |
| 8,851,038 | B1 | 10/2014 | Iskenderian | |
| 2006/0016406 | A1* | 1/2006 | Geyer | F01L 1/14 123/90.5 |
| 2010/0000476 | A1* | 1/2010 | Kunz | F01L 1/14 123/90.5 |
| 2010/0294219 | A1* | 11/2010 | Prokop | F01L 1/14 123/90.5 |
| 2015/0090209 | A1* | 4/2015 | Berruet | F04B 1/0439 123/90.26 |

FOREIGN PATENT DOCUMENTS

| | | |
|---|---|---|
| GB | 999507 | 7/1965 |
| WO | 2016145133 | 9/2016 |

* cited by examiner

*Primary Examiner* — Jorge Leon, Jr.

(57) ABSTRACT

A guide assembly for a valve lifter of an engine. The valve lifter is at least partly received within a bore of a body of the engine and an end portion of the valve lifter is exposed to an outside of the body. The guide assembly includes a pin and a guide. The pin is adapted to be fixedly coupled to the end portion of the valve lifter, while the guide is adapted to be coupled to the body. The guide defines a channel. The pin is received within the channel and cooperates with the channel to facilitate a movement of the valve lifter along an axis of the bore and to restrict a rotation of the valve lifter about the axis of the bore.

17 Claims, 4 Drawing Sheets

GUIDE ASSEMBLY FOR VALVE LIFTERS OF ENGINES

TECHNICAL FIELD

The present disclosure relates in general to valve trains in internal combustion engines. More particularly, the present disclosure relates to a guide assembly for valve trains that restricts a rotation of a valve lifter of the valve trains.

BACKGROUND

Generally, valve trains in internal combustion engines (referred also to as engines) employ a valve lifter to transmit motion from a rotating cam lobe to one or more valves of the engines. During engine operations, for example, a valve lifter translates along a longitudinal axis, converting a rotary motion of the cam lobe into a reciprocatory action of the one or more valves, thereby facilitating an opening and a closure of the one or more valves, for engine operation.

Although operations of a valve lifter are commonly limited to a transition along the longitudinal axis during translatory motions, in some circumstances, a valve lifter may also undesirably turn about the longitudinal axis. Because of such turning (or rotation), an alignment between one or more components of the valve train may be altered. For example, a roller of the valve lifter, which may interact with the cam lobe, may move out of alignment with respect to the cam lobe, causing an incorrect engagement between the roller and the cam lobe. Such incorrect alignment/engagement may lead to an increased friction between the roller and the cam lobe, in turn causing an increased vulnerability of roller wear (and/or cam lobe wear), and thus, potential valve train failures.

U.S. Pat. No. 3,668,945 ('945 reference) discloses a guard that prevents roller tappets of a fuel injection pump from turning about their axes, during operation. The roller tappets are provided with flattened portions that cooperate with flattened parts of a securing pin to prevent the roller tappets from rotation.

SUMMARY OF THE INVENTION

In one aspect, the disclosure is directed towards a guide assembly for a valve lifter of an engine. The valve lifter is at least partly received within a bore of a body of the engine and an end portion of the valve lifter is exposed to an outside of the body. The guide assembly includes a pin and a guide. The pin is adapted to be fixedly coupled to the end portion of the valve lifter, while the guide is adapted to be coupled to the body. The guide defines a channel, and the pin is received within the channel and cooperates with the channel to facilitate a movement of the valve lifter along an axis of the bore and to restrict a rotation of the valve lifter about the axis of the bore.

In another aspect, the disclosure relates to a valve train for an engine. The engine includes a body. The valve train includes a valve lifter, a pin, and a guide. The valve lifter is adapted to be at least partly received within a bore of the body and is movable along an axis of the bore. The valve lifter includes an end portion adapted to be exposed to an outside of the body. The pin is fixedly coupled to the end portion. The guide defines a channel and is adapted to be coupled to the body. The pin is received within the channel and cooperates with the channel to facilitate a movement of the valve lifter along the axis and to restrict a rotation of the valve lifter about the axis.

In yet another aspect, the disclosure is directed to an engine. The engine includes a body, a valve lifter, a pin, and a guide. The body defines a bore. The valve lifter is at least partly received within the bore and is movable along an axis of the bore. The valve lifter includes a second end portion that is exposed to an outside of the body. Further, the pin is fixedly coupled to the second end portion, while the guide defines a channel and is coupled to the body. The pin is received within the channel and cooperates with the channel to facilitate a movement of the valve lifter along the axis and to restrict a rotation of the valve lifter about the axis.

DETAILED DESCRIPTION

Figure 1:
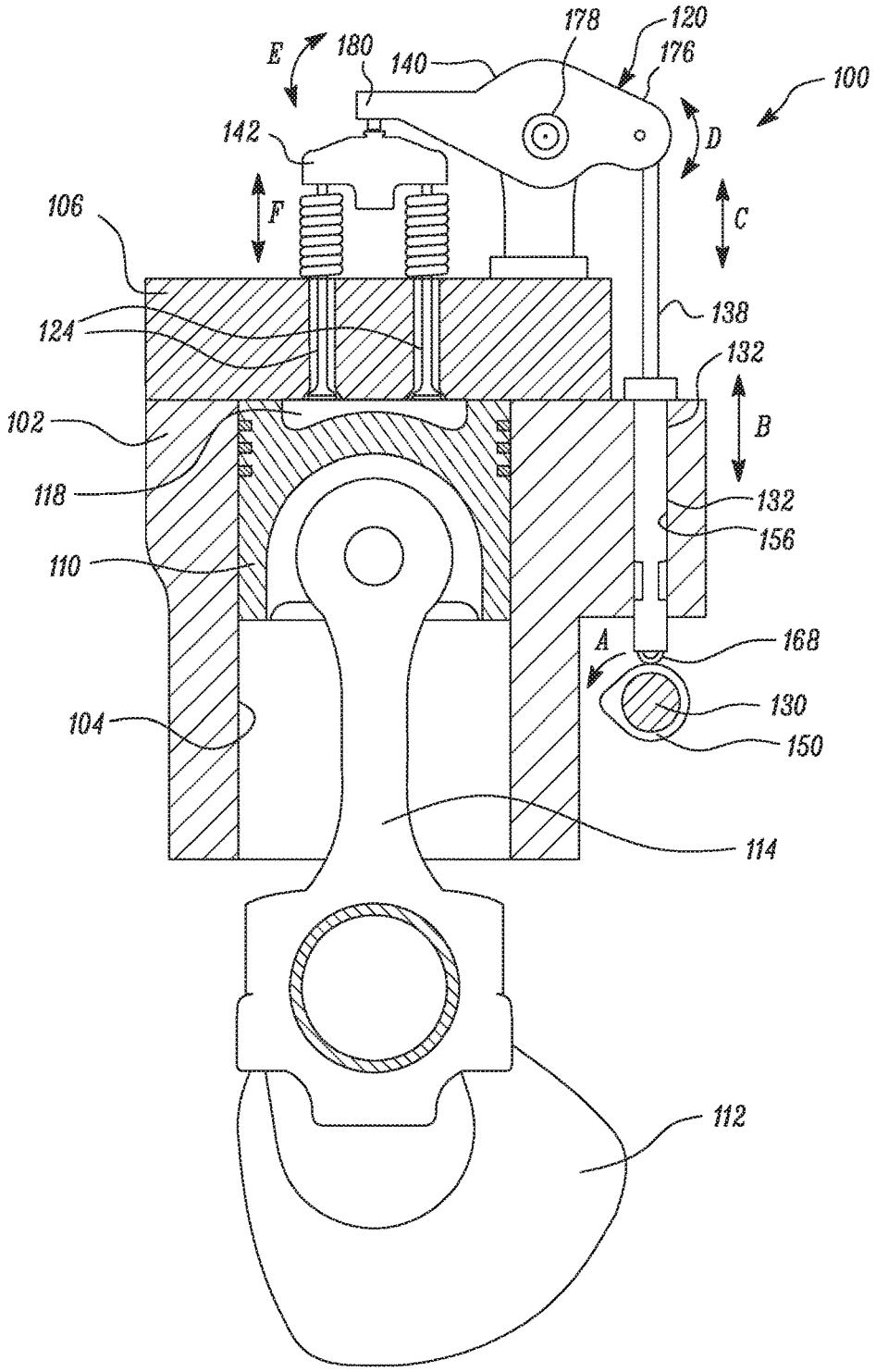
FIG. 1 is a schematic view of an engine with a valve train, in accordance with an embodiment of the disclosure.

Referring to FIG. 1, there is shown an internal combustion engine (simply referred to as engine 100). The engine 100 may be applicable in various machines, such as different types of earth-working machines including wheel loaders, backhoe loaders, hydraulic excavators, cranes, skid steer loaders, mining machines, off-highway trucks, autonomous machines, semi-autonomous machines, etc. The engine 100 may also be applied in stationary power generating units, such as generator sets. An applicability of the aspects of the present disclosure may also extend to vehicles and other widely applied power consumption units. Reference will now be made in detail to embodiments of the present disclosure, examples of which are illustrated in the accompanying drawings. Wherever possible, the same reference numbers will be used throughout the drawings to refer to the same or like parts.

The engine 100 may be a reciprocating engine and may be functionally implemented as one of a diesel engine, a gasoline engine, a stratified charge compression ignition (SCCI) engine, a homogeneous charge compression ignition (HCCI) engine, etc. In an embodiment, the engine 100 may be a dual fuel engine or a gaseous engine. For example, the engine 100 may use natural gas, propane gas, methane gas or any other suitable gaseous fuel, either alone or in any combination, for combustion and subsequent operation. The engine 100 may work on a two-stroke principle or a four-stroke principle, or any other conventionally known principle. Although such configurations of the engine 100 are disclosed, aspects of the present disclosure need not be limited to any particular engine type.

The depiction of the engine 100 in FIG. 1 is schematic in nature and is illustrated to have a single cylinder configuration, but it will be appreciated that the engine 100 may include a multi-cylinder configuration as well. For ease in reference and understanding, a description provided in the present disclosure may be directed towards the single cylinder configuration alone, but it will be appreciated that such discussions are equivalently applicable to a multi-cylinder configuration, as well.

The engine 100 includes a body 102, a cylinder 104 formed within the body 102, a cylinder head 106 arranged atop the body 102 at one end of the cylinder 104, a piston 110 movably arranged within the cylinder 104, and a crankshaft 112 coupled to the piston 110 via a connecting rod 114 of the engine 100. The engine 100 also defines a combustion chamber 118 delimited by the piston 110, the cylinder head 106, and the cylinder 104, as is well known.

The engine 100 further includes a valve train 120 that may facilitate a fuel change inflow (or a compressed air charge inflow) into the combustion chamber 118 and an exhaust gas outflow from the combustion chamber 118. The valve train 120 may include one or more components, and such components may be supported and/or be accommodated by the cylinder head 106. For example, the one or more components of the valve train 120 include a pair of intake valves 124 and a pair of exhaust valves (the pair of exhaust valves are not shown). The intake valves 124 facilitate an intake of a volume of air into the combustion chamber 118, while exhaust valves facilitate a discharge of exhaust gases of combustion from the combustion chamber 118. In application, the combustion chamber 118 may receive an air-fuel mixture through the intake valves 124, and by one or more of a spark, a compression, or by other known means, the air-fuel mixture may be ignited to result in combustion within the combustion chamber 118. A combustion of the air-fuel mixture causes the piston 110 to move across a length (i.e. from a Top Dead Center (TDC) to a Bottom Dead Center (BDC)) of the cylinder 104, executing a stroke, such as a power stroke, of a combustion cycle of the engine 100. Notably, a combustion cycle involving a movement of the piston 110 to execute an intake stroke, a compression stroke, a power stroke, and an exhaust stroke, is well known, and thus, does not necessitate further discussion. A movement of the piston 110 causes the crankshaft 112 to rotate, thereby generating rotary power applicable to power a machine (or any requirement) associated with the engine 100.

Figure 2:
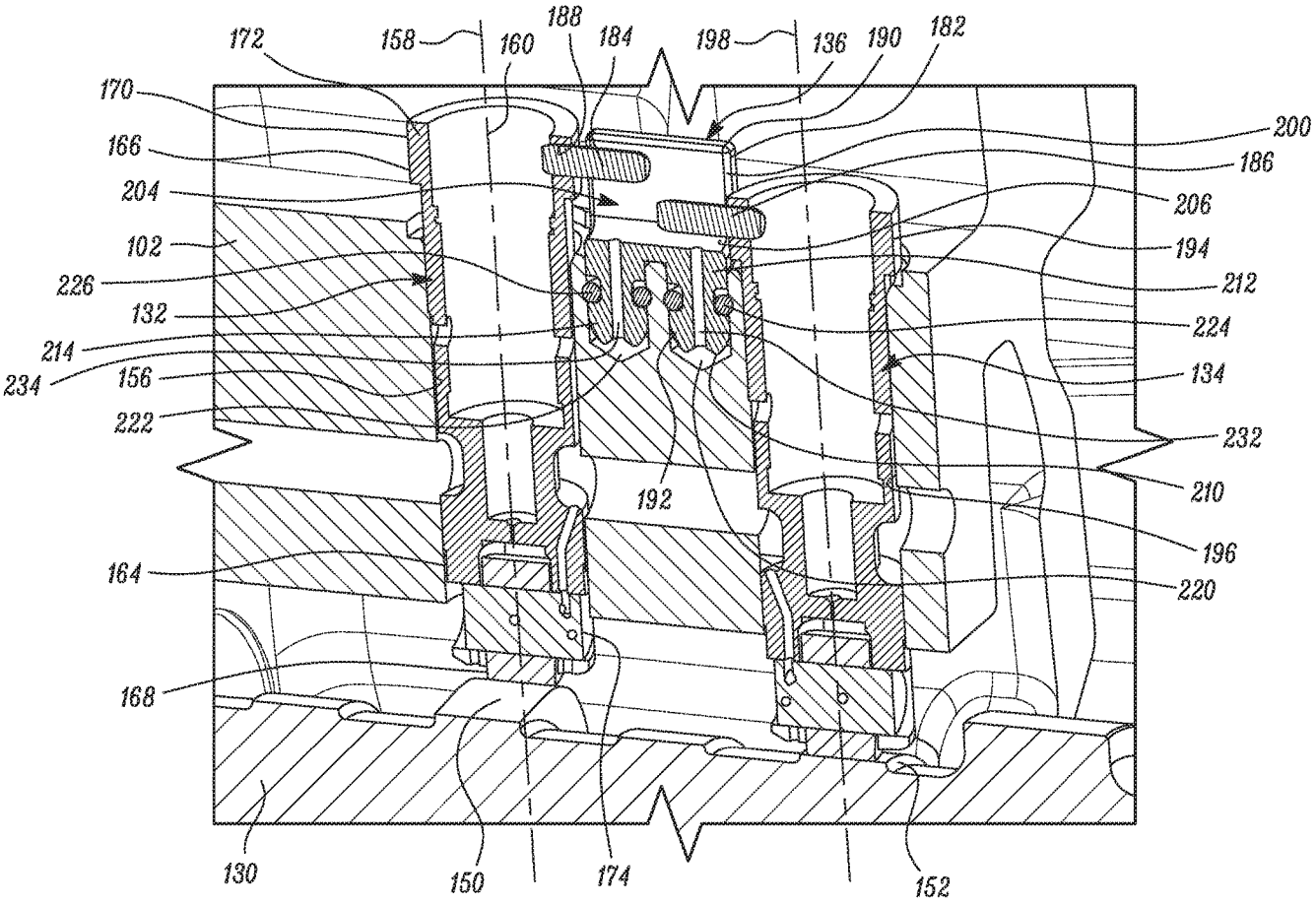
FIG. 2 is a cross-sectional view of a body of the engine, illustrating certain components of the valve train, in accordance with an embodiment of the disclosure.

Referring to FIGS. 1 to 4, apart from the intake valves 124 and the exhaust valves, the valve train 120 includes additional components as well. More specifically, the valve train 120 includes a camshaft 130 (see depictions in FIG. 1 and a sectional view of the camshaft 130 provided in FIG. 2). Further, as shown in FIG. 2, the valve train 120 includes a first valve lifter 132 (also see FIG. 1), a second valve lifter 134, a guide assembly 136 to guide a movement of the first valve lifter 132 (and the second valve lifter 134). Also, as shown in FIG. 1, the valve train 120 includes a pushrod 138, a rocker arm 140, and a valve bridge 142.

The camshaft 130 is operably engaged with the crankshaft 112, such as by a belt or by a gear, and therefore, a rotation of the crankshaft 112 results in a rotation of the camshaft 130 (or that the camshaft 130 is driven by the crankshaft 112). A rotary motion of the camshaft 130 results in an opening and a closure of the intake valves 124 (and the exhaust valves)—such an operational aspect will be understood as the disclosure proceeds. In the depicted embodiment of FIG. 2, a number of cam lobes have been structured and arranged on and along a length of the camshaft 130, with two cam lobes, i.e. a first cam lobe 150 and a second cam lobe 152 being in respective engagement with the first valve lifter 132 and the second valve lifter 134.

A forthcoming description includes details of the first valve lifter 132 and the second valve lifter 134. Because a form and function of the second valve lifter 134 may remain similar to the first valve lifter 132, details and an environment pertaining to only the first valve lifter 132 is described. Unless specified otherwise, such details and environment described for the first valve lifter 132 will be equivalently applicable to the second valve lifter 134 (and possibly other valve lifters of the engine 100), as well. Accordingly, it may be noted that in FIGS. 2, 3, and 4, a majority of annotations and callouts have been provided corresponding to the first valve lifter 132 and the first cam lobe 150 alone. For ease of understanding and reference, the first valve lifter 132 may be simply referred to as a valve lifter 132, while the first cam lobe 150 may be simply referred to as a cam lobe 150. Wherever required, however, specific references related to the second valve lifter 134, aspects of the second valve lifter 134, and certain surrounding components and features of the second valve lifter 134, may also be made. Moreover, references to the first valve lifter 132 may also be used.

The valve lifter 132 is movably and at least partly received within a bore 156 of the body 102. For example, the bore 156 may define an axis 158, and the valve lifter 132 may reciprocate within the bore 156 along the axis 158. The valve lifter 132 defines a longitudinal axis 160, and includes a first end portion 164 and a second end portion 166. The first end portion 164 accommodates a roller 168 (also see exemplary roller 168 depiction provided in FIG. 2), while the second end portion 166 (or simply an end portion 166 of the valve lifter 132) extends outwardly from the bore 156, and is thus exposed to an outside of the body 102 (see example depiction in FIG. 2). Although not limited, the valve lifter 132 has a cylindrical profile defined along an entire length (or along the longitudinal axis 160) of the valve lifter 132. The second end portion 166 of the valve lifter 132 includes a flanged portion 170, that has a diameter greater than a diameter of the rest of a body of the valve lifter 132. The flanged portion 170 limits a movement of the valve lifter 132 into the bore 156. The valve lifter 132 is configured to move between a lower most position and an upper most position relative to the body 102 owing to a rotation of the cam lobe 150. In the upper most position, the flanged portion 170 is positioned at a distance from the body 102 (see exemplary depiction in FIG. 2), along the axis 158, while in the lower most position, the flanged portion 170 abuts the body 102, and thereby restricts a movement of the valve lifter 132 into the bore 156. Therefore, the flanged portion 170 (i.e. the second end portion 166) at least partly extends outside the bore 156, and, in that manner, is thus at least partly exposed to the outside of the body 102. The flanged portion 170 includes a wall 172, and by moving in a direction from the first end portion 164 towards the second end portion 166, the wall 172 extends linearly and axially away from a remaining portion of the body of the valve lifter 132.

The roller 168 may rotate about a roller pin 174 that is fixedly coupled to the first end portion 164 of the valve lifter 132, and which is positioned substantially perpendicularly to the longitudinal axis 160 of the valve lifter 132. The term "substantially perpendicularly" means that an angle between an axis of the roller pin 174 and the longitudinal axis 160 of the valve lifter 132 is close to being a right angle, barring angular differences arising due to manufacturing tolerances. The roller 168 is in slidable engagement with the cam lobe 150 and rides on the cam lobe 150, ensuring that a characteristic profile of the cam lobe 150 is followed by the roller 168 as the cam lobe 150 rotates (see direction, A) with the camshaft 130, during operation. Due to such slidable engagement between the roller 168 with the cam lobe 150, the cam lobe 150 facilitates a reciprocal movement of the valve lifter 132 within the bore 156, along the axis 158 of the bore 156.

At the second end portion 166 of the valve lifter 132, the valve lifter 132 is coupled to the pushrod 138 (see FIG. 1), and thus a reciprocal motion (see direction, B) of the valve lifter 132, imparted by a rotation of the cam lobe 150 (see direction, A), is translated to a reciprocal motion of the pushrod 138 (see direction, C). The pushrod 138 is in turn coupled to a first rocker arm end 176 of the rocker arm 140, thereby causing a pivotal movement (see direction, D) of the rocker arm 140 about a rocker arm pin 178. Thus, the reciprocal motion of the pushrod 138 causes angular movements of the first rocker arm end 176 and a second rocker arm end 180, in opposite directions (understandable by viewing directions, D & E). The rocker arm 140 is coupled to the intake valves 124 via a valve bridge 142 at the second rocker arm end 180, and thus, a movement of the second rocker arm end 180 facilitates an opening and closing (see direction, F) of the intake valves 124 relative to the combustion chamber 118 of the engine 100. It will be appreciated that a similar mechanism may facilitate an opening and closing of the exhaust valves (not shown) relative to the combustion chamber 118, as well.

On occasions, during busy valve closure and opening events, such as via the mechanism discussed above, the valve lifter 132 may be subject to operational forces, and one or more components of such forces may undesirably cause the valve lifter 132 to turn and/or rotate about the longitudinal axis 160. One or more aspects of the present disclosure contemplates the use of the guide assembly 136 that is adapted to restrict such a rotation.

The guide assembly 136 includes a guide 182 and a pin 184. The pin 184 is in engagement with the valve lifter 132, as may be understood from the below description. As shown in FIG. 2, it may be noted that the guide assembly 136 includes two pins, and thus the pin 184 may be a first pin 184, with the guide assembly 136 including a second pin 186. The second pin 186 is in engagement with the second valve lifter 134 at an end portion 194 of the second valve lifter 134 (this is similar to an engagement of the first pin 184 to the second end portion 166). In one implementation, it will be understood that the bore 156 is a first bore 156 and the axis 158 is a first axis 158, with the body 102 including a second bore 196 defining a second axis 198. As with the first valve lifter 132, the second valve lifter 134 may be positioned within the second bore 196 and may be movable along the second axis 198. Since a form, function, and arrangement, of the second valve lifter 134 and the second pin 186 is same as that of the first valve lifter 132 and the first pin 184 (hereinafter referred to as the pin 184), a description and arrangement of the first valve lifter 132 (i.e. simply the valve lifter 132), in conjunction with the pin 184, is alone explained for clarity and ease.

The pin 184 is adapted to be fixedly coupled to the second end portion 166 of the valve lifter 132. By way of a fixed coupling of the pin 184 to the valve lifter 132, the pin 184 may move with a longitudinal movement of the valve lifter 132. For example, a reciprocal movement of the valve lifter 132 along the axis 158 may result in a synchronously attained movement of the pin 184, as well.

Figure 3:
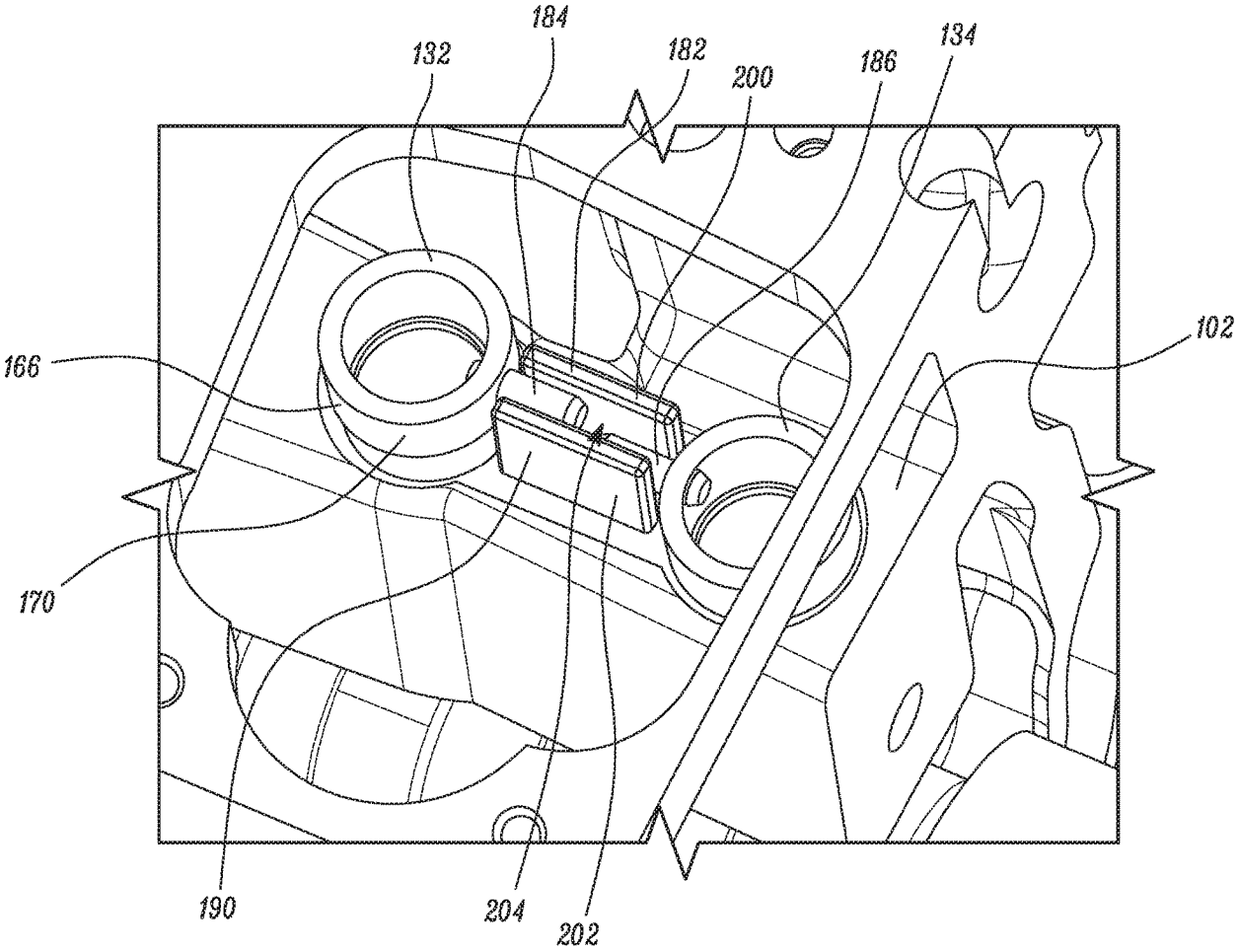
FIG. 3 is a top perspective view of the body of the engine, with the valve train installed within the engine, in accordance with an embodiment of the disclosure.
Figure 4:
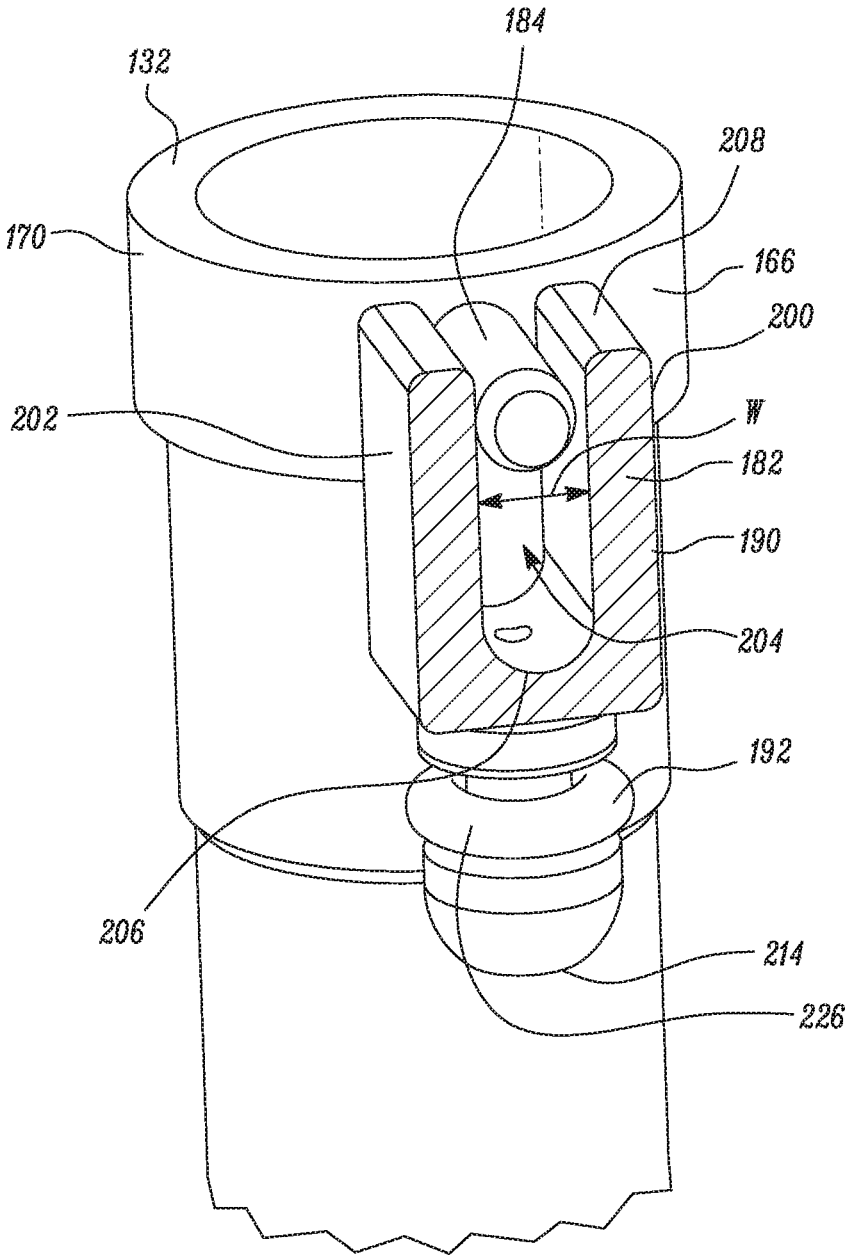
FIG. 4 is a sectional view of a guide assembly of the valve train with certain surrounding components of the engine removed, in accordance with an embodiment of the disclosure.

In one implementation, the pin 184 is adapted to be coupled to the second end portion 166 of the valve lifter 132 such that the pin 184 protrudes radially outwardly from the flanged portion 170 (also see FIG. 3). In one scenario, therefore, the pin 184 extends normal to a longitudinal axis 160 of the valve lifter 132. In yet one implementation, the second end portion 166 (or the flanged portion 170 of the valve lifter 132) includes an aperture 188, and the pin 184 is coupled to the second end portion 166 by being inserted and press-fitted within said aperture 188. Nevertheless, it is also possible that the pin 184 is one or more of threadably coupled to the aperture 188, or is coupled to the second end portion 166 by welding, snap fit, luer-lock arrangement, or is secured to the second end portion 166 by other well-known fastening means. In one embodiment, the aperture 188 may be omitted and the pin 184 may be integrally formed with the flanged portion 170 at the second end portion 166.

The guide 182 is adapted to be coupled to the body 102 of the engine 100. The guide 182 includes an upper section 190 and a lower section 192. The upper section 190 may include a U-shaped profile (see FIG. 4) and the lower section 192 may include an inverted U-shaped profile (see FIG. 2). The lower section 192 extends from the upper section 190. The upper section 190 includes a first guide member 200 and a second guide member 202. The first guide member 200 and the second guide member 202 may be both planarly shaped members (or components) that are parallelly disposed relative to each other. The second guide member 202 is spaced apart from the first guide member 200, with a channel 204 being defined between the first guide member 200 and the second guide member 202. The channel 204 defines a channel width, W, (i.e. equal to a distance between the first guide member 200 and the second guide member 202). Since the guide members 200, 202 are planarly defined, the channel 204 too is planarly defined without interruption and without any change in channel width, W, across a planarly defined expanse of the guide members 200, 202. In an embodiment, however, the channel width, W, may vary across a planarly defined expanse of the guide members 200, 202. In one embodiment, the guide members 200, 202 are integrally formed with the guide 182, with the first guide member 200 seamlessly and contiguously merging into the second guide member 202 through an arcuate section 206 of the guide 182, thus imparting a 'U-shape' to the upper section 190. In an embodiment the channel width, W, may increase in a direction away from the arcuate section 206 of the channel 204. In such a case, the channel width, W, is minimum at the arcuate section 206.

According to one embodiment, the guide members 200, 202 may include a rectangular shaped profile, as shown. Accordingly, the channel 204, defined between the guide members 200, 202, may include a rectangular shaped profile, as well. The channel 204 may be open from three sides (of such a rectangular shaped profile), as shown, with each open side facilitating access into the channel 204 thereof. A fourth side of the channel 204 however may be closed by the arcuate section 206. Understandably, therefore, the guide 182 may define an upper guide end 208, oppositely to the arcuate section 206, where the channel 204 may be open, and through which it is possible to receive the pin 184 into the channel 204, during assembly. Given the rectangular profile of the channel 204, the channel 204 also defines a length and a breadth. The length is defined along an extension of the arcuate section 206, and understandably, the breadth of the channel 204 is defined at right angles to the length (see FIG. 2). In assembly, the guide 182 may be placed such that the breadth of the channel 204 is positioned along (or parallelly) to the axis 158 of the bore 156, while the length is positioned at right angles to the axis 158 of the bore 156. Instead of the length, alternatively, it is possible that the breadth is defined along an extension of the arcuate section 206, and in such case, in assembly, the guide 182 may be placed such that the length of the channel 204 is positioned along (or parallelly) to the axis 158 of the bore 156. Further, the guide 182 may be made from plastic or sintered metal insert, although a variety of other materials such as a polymer, steel, or alloys, may be contemplated.

A dimension of the channel 204 may compliment and match with a dimension of the pin 184 so that the channel 204 may receive the pin 184, during assembly. For example, the channel width, W, may be similar to a thickness (or a diameter) of the pin 184. The term 'similar' may be understood as a reference to a similarity that exists between a dimension of thickness of the pin 184 and a dimension of the channel width, W, and not equality—understandably, for the channel 204 to receive and compliment the pin 184, the channel width, W, may be slightly larger than the thickness of the pin 184. Therefore, in assembly, the pin 184 may clear the channel width, W, and be accommodated within the channel 204 of the guide 182, but with a minimal clearance existing between pin 184 and the guide members 200, 202 with such minimal clearance being maintained such that a play between the channel 204 and the pin 184 is minimized. Notably, such minimal clearance may vary and may not remain same for all engine configurations, and may thus take any industrially accepted value. As the pin 184 is received within the channel 204, the pin 184 is also able to cooperate with the channel 204 during a movement of the valve lifter 132 along the axis 158 of the bore 156. A cooperation between the channel 204 and the pin 184 facilitates a movement of the valve lifter 132 along the axis 158 of the bore 156, but also restricts a rotation of the valve lifter 132 about the axis 158 of the bore 156.

The lower section 192 of the guide 182 extends from the upper section 190 to a lower end 210 of the guide 182. In an embodiment, the guide 182 may be coupled to the body 102 by at least a partial insertion of the lower section 192 into the body 102. The lower section 192 may be integrally formed with the upper section 190. Further, as shown, the lower section 192 may include one or more stems, for example a first stem 212 and a second stem 214, integrally and contiguously extending from the upper section 190. Although two stems are contemplated, additional or lesser stems may also be contemplated.

It may be noted that the first stem 212 and the second stem 214 facilitate a coupling of the guide 182 to the body 102 of the engine 100. To this end, the body 102 includes one or more slots—namely a first slot 220 and a second slot 222 (see FIG. 2) to respectively receive the first stem 212 and the second stem 214. A number of the slots provided in the body 102 may be complimentary to a number of the stems provided in the guide 182. The slots 220, 222 may be formed by drilling into the body 102, for example. In an embodiment, the stems 212, 214 may be received by press-fitting into the slots 220, 222, and in that way, the stems 212, 214, and thus, the guide 182, may be coupled and retained to the body 102. In yet another embodiment, one or more O-rings may be disposed around the stems 212, 214, and, in assembly with the body 102, such O-rings may be positioned at interfaces respectively defined between the slots 220, 222 and the stems 212, 214. For example, a first O-ring 224 may be disposed around the first stem 212 and positioned inside the first slot 220, while a second O-ring 226 may be disposed around the second stem 214 and positioned inside the second slot 222. The O-rings 224, 226 may facilitate a retention of the stems 212, 214, and thus the guide 182, within the slots 220, 222 of the body 102 of the engine 100. In one implementation, the guide 182 may be coupled to the body 102 such that the stems 212, 214 are fully inserted into the slots 220, 222, leaving the upper section 190 exposed to the outside of the body 102. Since the channel 204 is formed in the upper section 190, as may be understood by now, the channel 204 may too be exposed to the outside.

Further, each of the first stem 212 and the second stem 214 may include a passageway, termed respectively as a first passageway 232 and a second passageway 234. The passageways 232, 234 are provided so as to facilitate a release of a volume of air that may be trapped within the slots 220, 222 during an assembly of the stems 212, 214 into the slots 220, 222.

By having the two stems 212, 214, it is possible for the guide 182 to be restricted against a rotating torque acting against the guide 182, during operation. Although such a two-stem configuration is proposed in the above discussion, it is possible that the guide 182 may include a single stem configuration as well. For example, it is possible for a single stem to include one or more planar surface, that may cooperate against one or more planar surfaces of a corresponding slot, similar to slots 220, 222 formed within the body 102 of the engine 100, to prevent any torque acting against the guide 182 from turning from a preset, desired arrangement of the guide 182.

INDUSTRIAL APPLICABILITY

During assembly, an operator may first mount the guide 182 to the body 102 of the engine 100. This is performed by inserting and press-fitting the stems 212, 214 into the slots 220, 222. In some implementations, the stems 212, 214 are inserted till the upper section 190 abuts against the body 102 of the engine 100, leaving the upper section 190, and thus the channel 204, exposed to the outside of the body 102. Thereafter, the operator may bring forth the pin 184 and may insert the pin 184 into the aperture 188 and couple the pin 184 with the flanged portion 170 such that a portion of the pin 184 extends radially outwardly of the flanged portion 170. In that manner, the pin 184 is fixedly coupled to the valve lifter 132. Thus, at this point in assembly, the pin 184 extends radially outwardly relative to the longitudinal axis 160 of the valve lifter 132, as well. The operator may then insert the valve lifter 132 into the bore 156 such that the longitudinal axis 160 of the valve lifter 132 falls in line with the axis 158 of the bore 156, and also ensuring that the pin 184 (or at least a portion of the pin 184), slides into and is received within the channel 204 of the guide 182 from the upper guide end 208 (or from the fourth side of the channel 204). The insertion process is performed till the roller 168 of the valve lifter 132 abuts the cam lobe 150, and is slidably engaged with the cam lobe 150. In this position, at least a portion of the flanged portion 170 (i.e. the second end portion 166) remains exposed to the outside of the body 102. Once such an arrangement is attained, remaining components of the valve train 120, such as the valve bridge 142, the rocker arm 140, etc., are brought forth and are then assembled to the valve lifter 132. Since both the second end portion 166 and the upper section 190 of the guide 182 are exposed to the outside of the body 102, an assembly and removal of the guide assembly 136 is more easily attained (for example from a top of the engine 100) than conventional assembly/re-assembly practices, thus mitigating operator effort and time.

During operation, the valve lifter 132 is pushed by the cam lobe 150, by a rotation of the cam lobe 150, in a recurring manner. This push facilitates a translation of the valve lifter 132 along the axis 158 of the bore 156, converting the rotating action of the cam lobe 150 into a reciprocation of the valve lifter 132. Consequentially, the pin 184, fixedly coupled to the second end portion 166 of the valve lifter 132, reciprocates with the valve lifter 132 as well, moving and cooperating with the channel 204 along a direction parallel to the longitudinal axis 160 of the valve lifter 132. As the channel 204 is free to accommodate reciprocal movements of the pin 184 along a direction parallel to the longitudinal axis 160 of the valve lifter 132, the pin 184 moves freely along a direction parallel to the longitudinal axis 160 of the valve lifter 132. However, given the minimal clearance between the guide members 200, 202 and the pin 184, the pin 184 is restricted from rotating about the axis 158 of the bore 156. Owing to the profile of the channel 204, effectively, the channel 204 facilitates a movement of the valve lifter 132 along the axis 158 of the bore 156 and restricts a rotation of the valve lifter 132 about the axis 158 of the bore 156.

Although a number of components of the valve train 120 is disclosed, it is possible that one or more aspects of the present disclosure are implemented with one or more of these components removed or omitted from the engine 100. In some cases, therefore, a description of an immediate environment surrounding the valve lifter 132, the guide 182, and the pin 184, may be seen as being purely exemplary in nature, and it may be understood that the present disclosure discusses such an environment only to contemplate and explain one possible application of the valve train 120.

It will be apparent to those skilled in the art that various modifications and variations can be made to the system of the present disclosure without departing from the scope of the disclosure. Other embodiments will be apparent to those skilled in the art from consideration of the specification and practice of the system disclosed herein. It is intended that the specification and examples be considered as exemplary only, with a true scope of the disclosure being indicated by the following claims and their equivalent.

What is claimed is:

1. A guide assembly for a valve lifter of an engine, the guide assembly comprising:

a pin adapted to be fixedly coupled to an end portion of the valve lifter, wherein the valve lifter is at least partly received within a bore of a body of the engine, with the end portion of the valve lifter being exposed to an outside of the body of the engine; and a guide adapted to be coupled to the body, the guide defining a channel, wherein the pin is received within the channel and cooperates with the channel to facilitate a movement of the valve lifter along an axis of the bore and to restrict a rotation of the valve lifter about the axis of the bore;

wherein the body includes one or more slots, the guide including one or more stems adapted to be inserted and press-fitted into the one or more slots to facilitate a coupling of the guide to the body.

2. The guide assembly of claim 1, wherein the guide is adapted to be coupled to the body such that the channel is exposed to the outside of the body.

3. The guide assembly of claim 1, wherein the pin is adapted to be coupled to the end portion such that the pin extends normal to a longitudinal axis of the valve lifter.

4. The guide assembly of claim 1, further including an O-ring disposed around each of the one or more stems, each O-ring adapted to facilitate a retention of the one or more stems within the one or more slots.

5. The guide assembly of claim 1, wherein the guide includes a first guide member and a second guide member spaced apart from the first guide member, the channel being defined between the first guide member and the second guide member.

6. A valve train for an engine, the engine including a body, the valve train comprising:

a valve lifter adapted to be at least partly received within a bore of the body and being movable along an axis of the bore, the valve lifter including an end portion adapted to be exposed to an outside of the body;

a pin fixedly coupled to the end portion; and a guide adapted to be coupled to the body, the guide defining a channel, wherein the pin is received within the channel and cooperates with the channel to facilitate a movement of the valve lifter along the axis and to restrict a rotation of the valve lifter about the axis;

wherein the body includes one or more slots, the guide including one or more stems adapted to be inserted and press-fitted into the one or more slots to facilitate a coupling of the guide to the body.

7. The valve train of claim 6, wherein the guide is adapted to be coupled to the body such that the channel is exposed to the outside of the body.

8. The valve train of claim 6, wherein the pin is coupled to the end portion such that the pin extends normal to a longitudinal axis of the valve lifter.

9. The valve train of claim 6, wherein the end portion defines an aperture, the pin is coupled to the end portion by being press-fitted within the aperture.

10. The valve train of claim 6, further including an O-ring disposed around each of the one or more stems, each O-ring adapted to facilitate a retention of the one or more stems within the one or more slots.

11. The valve train of claim 6, wherein the guide includes a first guide member and a second guide member spaced apart from the first guide member, the channel being defined between the first guide member and the second guide member.

12. An engine, comprising:

a body defining a bore;

a valve lifter at least partly received within the bore and being movable along an axis of the bore, the valve lifter including an end portion exposed to an outside of the body;

a pin fixedly coupled to the end portion;

a guide coupled to the body, the guide defining a channel, wherein the pin is received within the channel and cooperates with the channel to facilitate a movement of the valve lifter along the axis and to restrict a rotation of the valve lifter about the axis;

wherein the body includes one or more slots, the guide including one or more stems inserted and press-fitted into the one or more slots to facilitate a coupling of the guide to the body.

13. The engine of claim 12, wherein the guide is coupled to the body such that the channel is exposed to the outside of the body.

14. The engine of claim 12, wherein the pin is coupled to the end portion such that the pin extends normal to a longitudinal axis of the valve lifter.

15. The engine of claim 12, wherein the end portion defines an aperture, the pin is coupled to the end portion by being press-fitted within the aperture.

16. The engine of claim 12, further including an O-ring disposed around each of the one or more stems, each O-ring facilitating a retention of the one or more stems within the one or more slots.

17. The engine of claim 12, wherein the valve lifter is a first valve lifter, the bore is a first bore, the axis is a first axis, and the pin is a first pin, the engine further including:

at least one second valve lifter moveable along a second axis of a second bore of the body, the at least one second valve lifter including a second end portion; and a second pin coupled to the second end portion, wherein the second pin is received within the channel and cooperates with the channel to facilitate a movement of the at least one second valve lifter along the second axis and to restrict a rotation of the at least one second valve lifter about the second axis.

* * * * *